US005726534A

United States Patent [19]

Seo

[11] Patent Number: 5,726,534

[45] Date of Patent: Mar. 10, 1998

[54] PREHEAT CURRENT CONTROL CIRCUIT BASED UPON THE NUMBER OF LAMPS DETECTED

[75] Inventor: Maeng-ho Seo, Kyonggi-do, Rep. of Korea

[73] Assignee: Samsung Electronics Co., Ltd., Suwon, Rep. of Korea

[21] Appl. No.: 636,263

[22] Filed: Apr. 24, 1996

[30] Foreign Application Priority Data

Jun. 5, 1995 [KR] Rep. of Korea ..... 95-14844

[51] Int. Cl.[6] ..... H05B 37/02

[52] U.S. Cl. ..... 315/97; 315/105; 315/107; 315/308

[58] Field of Search ..... 315/97, 106, 107, 315/308, 307, DIG. 7, 105

[56] References Cited

U.S. PATENT DOCUMENTS 5,550,433 8/1996 Tobler ..... 315/106

*Primary Examiner*—Robert Pascal
*Assistant Examiner*—Michael Shingleton
*Attorney, Agent, or Firm*—Cushman Darby & Cushman IP Group of Pillsbury Madison & Sutro LLP

[57] ABSTRACT

A feedback control system of ballast which has function to detect the number of lamp and is applied to an integrated circuit to control the ballast for a fluorescent lamp etc, and provides the ballast with the feedback control system which can detect the number of lamp, control ballast continuously by means of the n-lamp detector and soft start controller which produce the compensated current from the feedback current and direct link voltage. Therefore, the feedback control system can control the ballast accurately according to the load change such as the change of input voltage, number of lamp.

13 Claims, 4 Drawing Sheets

PREHEAT CURRENT CONTROL CIRCUIT BASED UPON THE NUMBER OF LAMPS DETECTED

BACKGROUND OF THE INVENTION

1. Field of the Invention

The present invention relates to a feedback control system for ballast in a lighting system, and more specifically to a feedback control system for lighting system ballast for lighting fixtures such as a fluorescent lamps which detects the number of lamps connected to the ballast and which uses an integrated circuit to control the ballast.

2.Description of Related Art

A conventional lighting ballast will initially be described with reference to the circuit diagram set forth in FIG. 1. As shown in FIG. 1, a conventional ballast includes two switching transistors $M_1$, $M_2$ connected together with diodes $D_1$, $D_2$ extending between their source and drain electrodes. Capacitors $C_1$, $C_2$ and $C_4$, $C_5$ are connected across transistors $M_1$ and $M_2$, and an inductor Lr and a lamp are connected in series between a point of contact between capacitors $C_1$ and $C_2$ and a point of contact between capacitors $C_4$ and $C_5$. A capacitor $C_3$ is connected to both ends of the lamp.

A ballast having these elements is a switching type LC resonance convertor. Driving signals $Out_1$, $Out_2$ are applied to gates of the switching transistors $M_1$ and $M_2$ to thereby control the path of current from direct link voltage E through the lamp.

The on-off frequency of the switching transistors $M_1$, $M_1$ is called the switching frequency. The ballast can be operated in an initial preheat mode, an instantaneous discharge mode and a continuous discharge mode by controlling the switching frequency.

The LC resonance frequency for a given ballast can be determined through known equations assuming L is the inductance of the inductor Lr and C is the equivalent capacitance of capacitors $C_1$ to $C_5$.

In this ballast, if the switching frequency is controlled to be higher than the LC resonance frequency, the power output from the device varies in inverse proportion to the switching frequency. Therefore, in the initial preheat mode, where relatively low power is required, the switching frequency should be relatively high, whereas in the continuous discharge mode, where full power is required, the switching frequency should be lower.

There are two well known soft start ballast control systems: feedforward control to detect input voltage and program control to set a fixed driving frequency. One problem with soft start control systems, however, is that they cannot control the ballast accurately when there is a large change in external circumstances, for example if there is a large change in input voltage. Further, soft start control systems cannot control the ballast properly during a load change, such as when the number of lamps changes and may not work if the feedforward is not set properly.

SUMMARY OF THE INVENTION

The ballast control system of this invention provides frequency control according to the number of lamps in the initial preheat mode, instantaneous discharge mode and continuous discharge mode. This ballast feedback control system provides many advantages—it can control the ballast stably against irregular load characteristics of the lamp, is energy efficient and prolongs the effective life of the lamp.

An object of the present invention is to provide a continuous feedback ballast control system which detects the number of lamps in the system. More particularly, an object of this invention is to provide a soft start signal and full output signal according to the number of lamps in the soft start and full power mode through the use of a feedback control system in order to overcome the above-mentioned technical problems.

To achieve the above purposes, a switching type ballast control system according to the present invention includes a detector to detect the number of lamps, a reference voltage generator which generates a reference voltage corresponding to the number of lamps detected by detector and a soft start controller which produces current corresponding to the number of lamps detected by the detector. A feedback unit and a main control unit are provided which add current generated by the feedback unit to a feedforward current from the direct link voltage and determines a control frequency of a driving signal of the ballast from this added current.

BRIEF DESCRIPTION OF THE DRAWINGS

The preferred embodiments of the present invention will now be described more specifically with reference to the attached drawings, wherein:

FIGS. 9A to 9D are waveforms of output signals of the driving circuit of FIG. 3.

DETAILED DESCRIPTION OF THE PREFERRED EMBODIMENT

Figure 1:
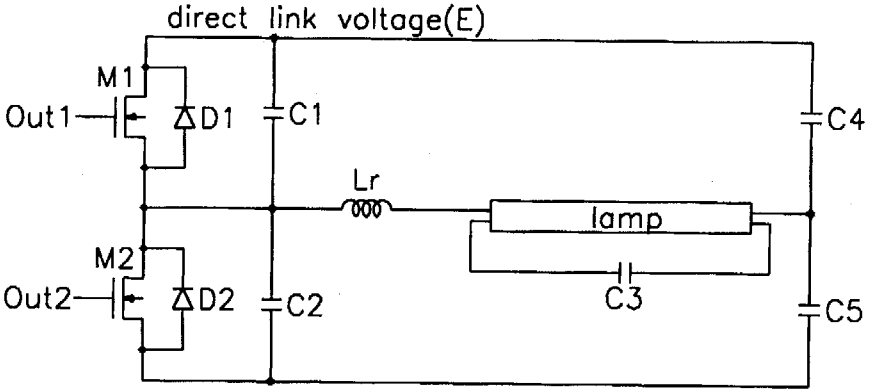
FIG. 1 (Prior Art)
FIG. 1 is a detailed circuit diagram of a conventional lighting ballast circuit.
Figure 2:
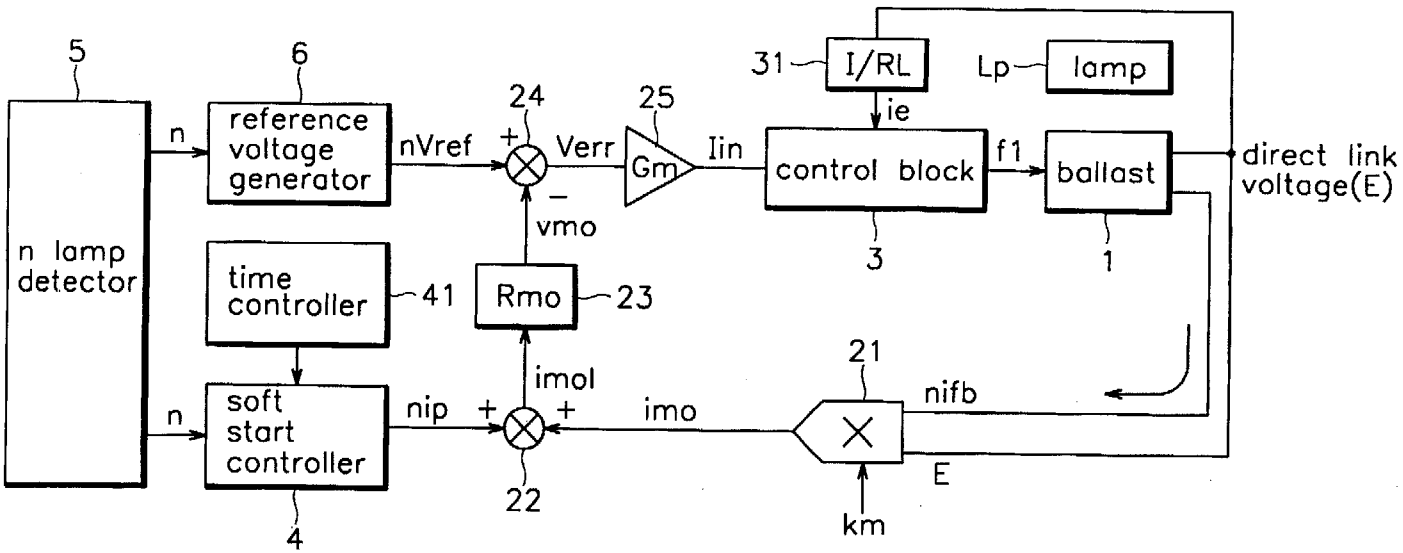
FIG. 2 is a block diagram of a lighting ballast control system according to a preferred embodiment of the present invention.

As shown in FIG. 2, a preferred ballast feedback control system of this invention includes a ballast 1 to which a lamp is attached. A n-lamp detector is provided which detects the number of lamps in the circuit. A reference voltage generator 6 receives a signal n indicative of the number of lamps in the circuit from the n-lamp detector and generates a reference voltage. A soft start controller 4 also receives a signal n indicative of the number of lamps in the circuit, and receives a signal from a time controller 41.

A direct link voltage E is applied to the ballast 1. The direct link voltage and a feedback current $ni_{fb}$ from the ballast are input to a multiplier 21, which produces an output current $i_{mo}$ by multiplying those two input values. The output current $i_{mo}$ may be expressed by the equation $i_{mo}=Km\times ni_{fb}\times E$ where Km is a multiplying constant. The output signal $i_{mo}$ from the multiplier 21 is input to an adder 22.

A n-lamp detector detects the number of lamps attached to the ballast 1 and outputs an output signal, the voltage of which varies in accordance with the number of detected lamps. This output voltage is input to a reference voltage generator 6 and a soft start controller 4.

The reference voltage generator produces a reference voltage $nV_{ref}$ corresponding to the output signal n from the n-lamp detector. The reference voltage $nV_{ref}$ is used to determine the input power of the ballast 1 and is input to the adder 24.

The soft start controller 4 produces a current signal nip from the output signal n from the n-lamp detector and an output signal from a time controller 41, which outputs a voltage in proportion to the time. This output signal $ni_p$ is input to the adder 22. The soft start controller 4 controls the magnitude of the output current $ni_p$ which is required in the initial preheat period, the instantaneous discharge period and the continuous discharge period. A detailed explanation of this function follows.

An adder 22 adds the current $ni_p$ of the soft start controller 4 to the output signal $i_{mo}$ of the multiplier 21. This added output signal $i_{mol}$ is input to a current to voltage convertor 23, which converts the input current $i_{mol}$ into voltage $V_{mo}$ and outputs the voltage $V_{mo}$ to an adder 24.

Adder 24 produces an error voltage $V_{err}$ by subtracting the output voltage $V_{mo}$ of the current to voltage convertor 23 from the reference voltage $nV_{ref}$ of the reference voltage generator 6. The error voltage $V_{err}$ input to the voltage to current convertor 25.

The voltage to current convertor 25 is formed of an error amplifier which has transconductance Gm and which converts the input voltage $V_{err}$ into the current $i_{in}$. The current $i_{in}$ is input to the control block 3.

The control block 3 produces a driving signal $f_1$ for ballast 1 from the feedforward current $i_e$ e of the direct link voltage E in inductor circuit 31, and the output current $i_{in}$ in from the voltage to current convertor 25. The driving signal $f_1$ is input to the ballast 1.

The control block 3 has ballast switching elements switched according to the driving signal $f_1$ by determining the control frequency of the driving signal $f_1$. A detailed explanation on the control block 3 will now be made with reference to FIG. 3, which is a detailed circuit diagram of the control block 3.

Figure 3:
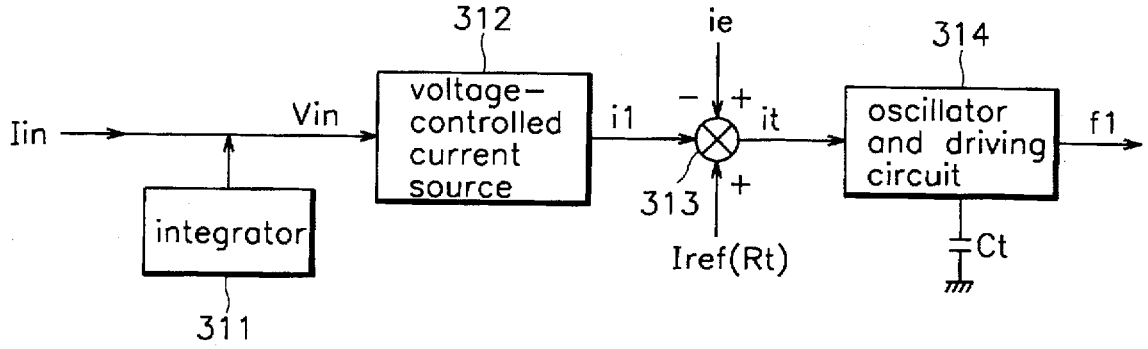
FIG. 3 is a detailed circuit diagram of the control block of FIG. 2.

As shown in FIG. 3, the control block 3 includes an integrator 311 which integrates the input current $i_{in}$ and a voltage-controlled current source 312 which produces a current $i_1$ from the integrated voltage $V_{in}$. An adder 313 produces a total output current $i_t$ by adding an internal reference current $i_{ref}$ and the feedforward current $i_e$ from the inductor circuit 31, and subtracting the output current $i_1$ from the voltage-controlled current source 312. An oscillator and driving circuit 314 produce the driving signal $f_1$ of the ballast 1 from the total output current $i_t$ of the adder 313.

Operation of the control block 3 will now be explained. The output current $i_{in}$ from the voltage to current convertor 25 is integrated in integrator 311, which outputs the voltage $V_{in}$ to a voltage-controlled current source 312. The voltage-controlled current source 312 outputs the current $i_1$ corresponding to the voltage $V_{in}$ generated by integrator.

The output current $i_1$ of voltage-controlled current source 312 is input to the adder 312 together with the output current $i_e$ from the inductor circuit 31 and the internal reference current $i_{ref}$. The adder 313 adds the output current $i_e$ of inductor circuit 31 to the reference current $i_{ref}$ and subtracts the output current $i_1$ of voltage controlled current source 312, to produce the total current $i_t$. This total current $i_t$ is input to the oscillator and driving circuit 314.

The oscillator and driving circuit 314 outputs a driving signal $f_1$ by charging capacitor $C_t$ with the total current $i_t$, and determines the control frequency of the driving signal $f_1$.

The control frequency of the driving signal $f_1$ determines the input power of the ballast 1. This input power is proportionate to the feedback current $ni_{fb}$ of ballast 1, which allows the control system of the ballast to be controlled by feedback control.

As discussed above, the reference voltage $nV_{ref}$ of the reference voltage generator is used to determine the input power.

The change of feedback current $ni_{fb}$ and direct link voltage E which used to determine the voltage $V_{mo}$ are controlled so that the output voltage $V_{mo}$ from the current to voltage convertor 23 is equal to the reference voltage $nV_{ref}$.

Therefore in adder 22, if the current $ni_p$ of soft start controller 4 increases, the output current $i_{mo}$ of multiplier 21 is reduced.

If the direct link voltage E is constant, the feedback current $ni_{fb}$ is reduced. This reduction in feedback current $ni_{fb}$ means that the control frequency of driving signal $f_1$ in control block is controlled to reduce the consumption of voltage of the ballast system.

As explained above, the feedback control system of ballast is applicable to the initial preheat mode. When feedback current $ni_{fb}$ is reduced by increasing the output current $ni_p$ of soft start controller 4, the feedback control system functions to preheat the lamp which is in an undischarged condition.

After the requisite preheating is complete, feedback current $ni_{fb}$ is controlled to produce the power required for discharge by reducing the current $ni_p$. During the continuous discharge period, the current $ni_p$ is set to zero.

In this way, the ballast system is optimally controlled to provide continuous feedback control in the initial preheat, instantaneous discharge and continuous discharge periods.

Figure 4:
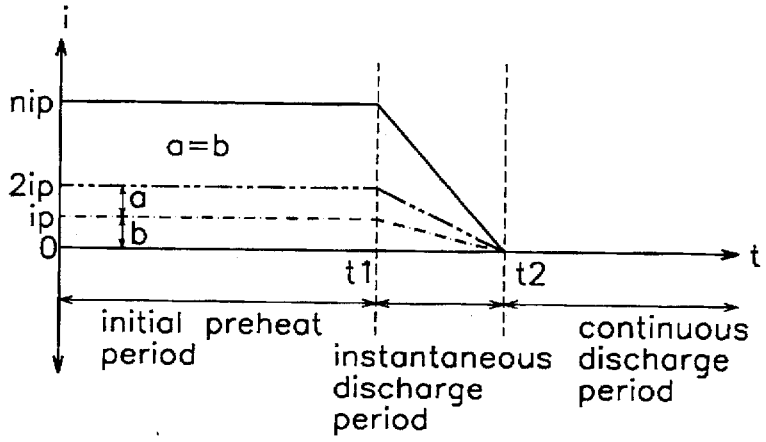
FIGS. 4 and 5 illustrate the current and power characteristics controlled by the soft start controller of FIG. 2.
Figure 5:
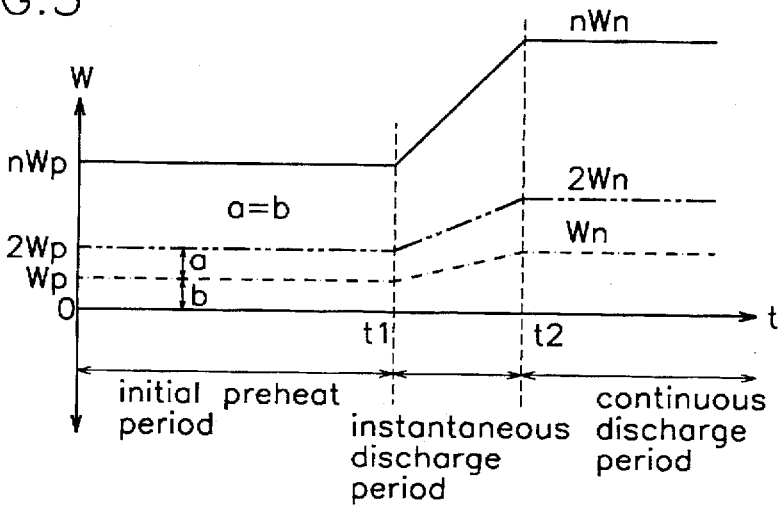

FIGS. 4 and 5 respectively illustrate current and voltage characteristics in the circuit when the current is controlled. As shown in these Figs., the current $ni_p$ and the power $nW_p$ are proportionately increased according to the number of lamps in the circuit.

When the current $ni_p$ of the soft start controller 4 is controlled to provide the current required for the initial preheat period, the system power $nW_p$ of the ballast is controlled to correspond to this current. For the instantaneous discharge period after the initial preheat period, the current $ni_p$ is reduced and the system power $nW_p$ is increased.

The feedback control system controls the current during the instantaneous discharge period to ensure that there is sufficient supplied power.

The continuous discharge period starts when the current $ni_p$ is reduced to zero. The power level during the continuous discharge period is the optimally controlled power of the ballast system.

Figure 6:
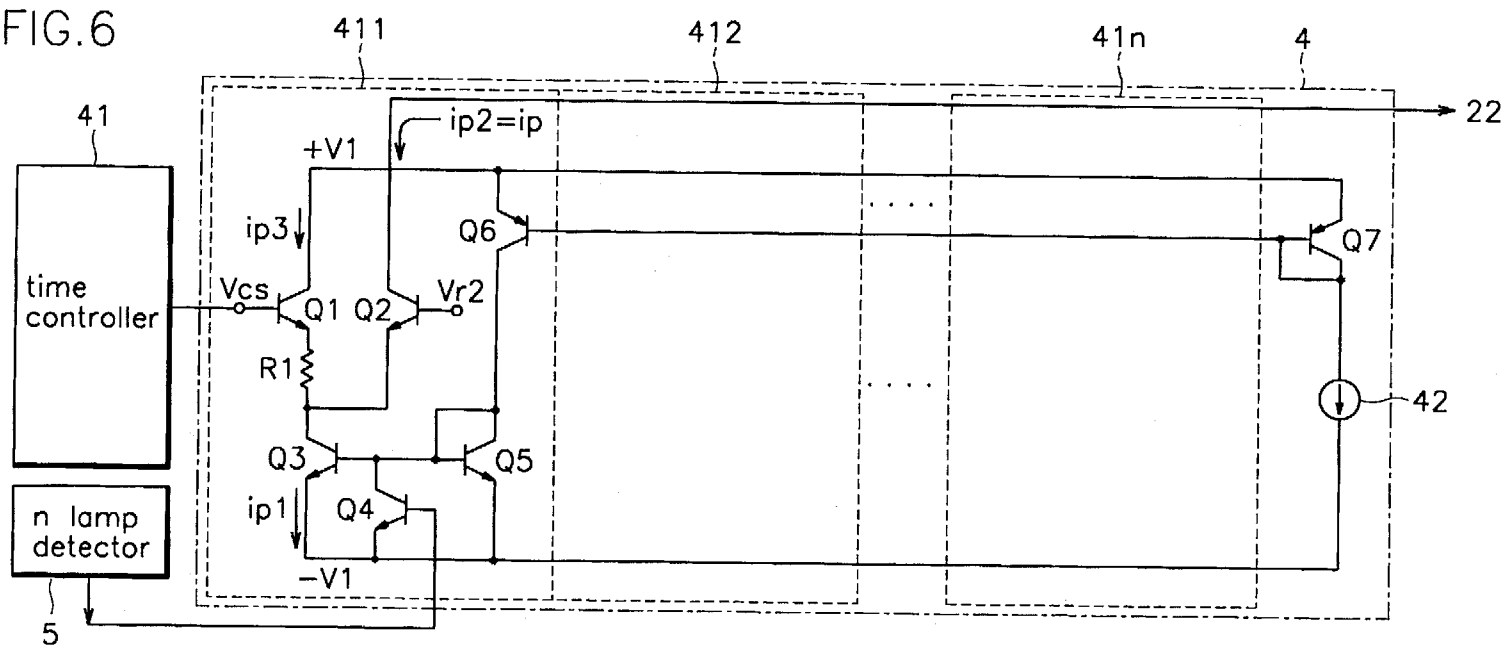
FIG. 6 is a detailed circuit diagram of the soft start controller of FIG. 2.
Figure 7:
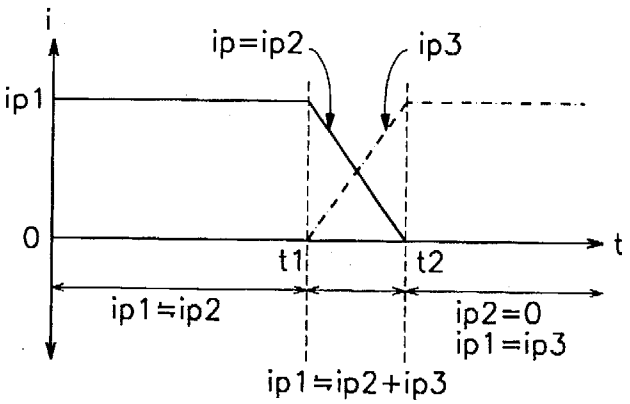
FIG. 7 illustrates the current characteristic through the soft start controller of FIG. 2.

FIG. 6 is a detailed circuit diagram of the soft start controller 4 and FIG. 7 illustrates current characteristics in the soft start controller 4.

As shown in FIG. 6, the soft start controller 4 includes n-cells 411 to 41*n*, transistor $Q_7$ and a current source 42 to supply current for each cell.

The current source 42 and transistor $Q_7$ supply current for each cell through the use of a current mirror or current lens. Since each cell is identical, the internal structure of only one cell 411 will be explained in detail below.

In cell 411, the base of transistor $Q_6$ is connected to the base of transistor $Q_7$. The emitter of transistor $Q_6$ is connected to the emitter of transistor $Q_7$. The emitter-collector current is proportional to the current of the current source The collector of the transistor $Q_6$ is connected to the collector of a transistor $Q_5$, which has its base and collector connected. The emitter of transistor $Q_5$ is connected to the current source 42.

The base of transistor $Q_5$ is connected to the base of transistor $Q_3$. The base of transistor $Q_3$ is connected to the collector of transistor $Q_4$. The output voltage of the n-lamp detector 5 is applied to the base of transistor $Q_4$. The emitter of transistor $Q_3$ is connected to the emitter of transistor $Q_4$. The transistor $Q_3$ can be turned on when the transistor $Q_4$ is turned on by the output voltage of the n-lamp detector.

As the transistor $Q_3$ and transistor $Q_5$ are mirrors of each other, such that current in proportion to the current through the collector of transistor $Q_6$ flows through the collector of transistor $Q_3$.

Constant voltage $V_{r2}$ applied to the base of the transistor $Q_2$ is applied to the collector of transistor $Q_3$. The collector of transistor $Q_3$ is also connected to the emitter of transistor $Q_2$ which is connected to the adder 22. The collector of transistor $Q_3$ is supplied by the output voltage $V_{cs}$ of time controller 41 and is connected to the emitter of transistor $Q_1$ which is connected to the collector of transistor $Q_6$ Resistor $R_1$ is connected between the emitter of transistor $Q_1$ and the collector of transistor $Q_3$.

In this structure, the collector current of transistor $Q_2$ is input to adder 22. The voltage $V_{cs}$ in proportion to the time of time controller 41 is input to the base of transistor $Q_1$. The output voltage of the n-lamp detector 5 to determine the operation of appropriate cell 411 is input to the base of transistor $Q_4$.

The sum of collector current $i_{p3}$ of transistor $Q_1$ and collector current $i_{p2}$ of transistor $Q_2$ is equivalent to the collector current $i_{p1}$ of transistor $Q_3$. The collector current of transistor $Q_3$ is determined by the current source 42.

Collector current $i_{p1}$ which is determined by the current source 42 and the mirror or lens relation between transistors $Q_6$ and $Q_7$, transistor $Q_3$ and $Q_5$ flows through the collector of transistor $Q_3$. At this time, the transistor $Q_4$ is turned on by the output voltage of the n-lamp detector 5, which turns transistors $Q_3$ and $Q_5$ on.

Transistor $Q_1$ starts to turn on when the voltage $V_{cs}$ of time controller 41 increases in proportion to time to be equal to the voltage $V_{r2}$ applied to the base of transistor $Q_2$. This moment corresponds to $t_1$ 4in FIG. 7.

Before $t_1$, collector current $i_{p1}$ of transistor $Q_3$ is nearly equivalent to the collector current $i_{p2}$ of transistor $Q_2$ After $t_1$, collector current $i_{p3}$ of transistor $Q_1$ increases proportionally and collector current $i_{p2}$ reduces proportionally. At this time the increasing slope of current $i_{p3}$ is inversely proportional to $R_1$.

When the collector current $i_{p3}$ of transistor $Q_1$ is nearly equal to the collector current $i_{p1}$ of transistor $Q_3$, collector current $i_{p2}$ of transistor $Q_2$ becomes zero. This moment correspond to $t_2$ in FIG. 7.

As described above, a ballast can be controlled continuously by controlling the collector current $i_{p2}$ of transistor $Q_2$ during the initial preheat, instantaneous discharge and continuous discharge periods.

Figure 8:
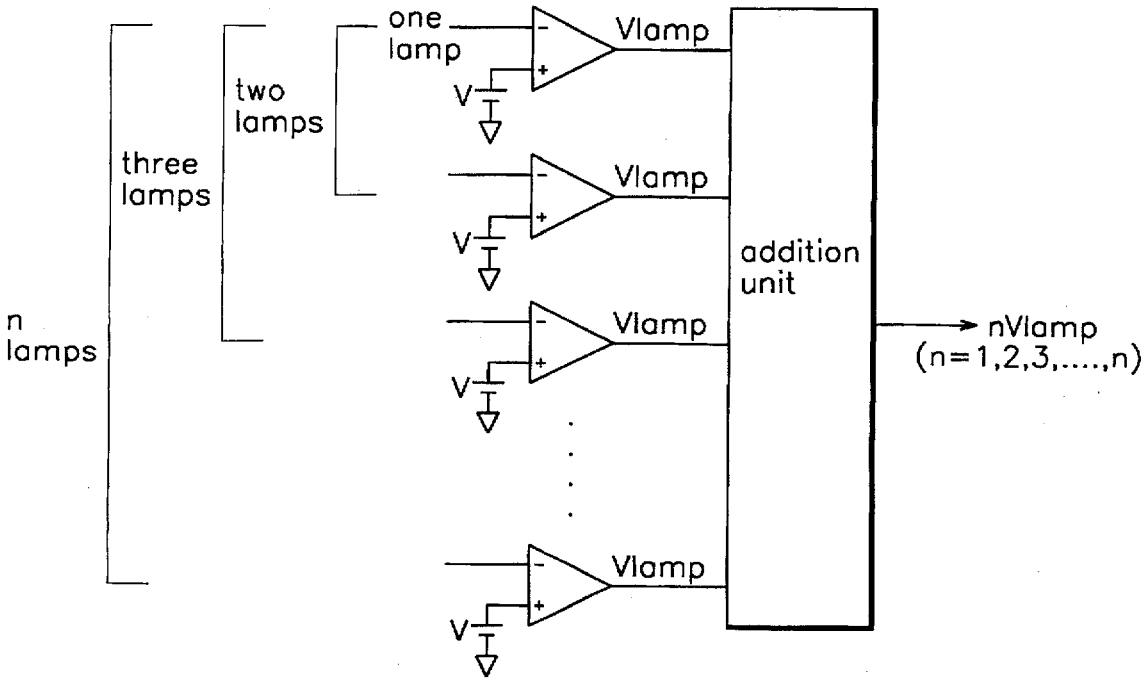
FIG. 8 is a detailed circuit diagram of the n-lamp detector box of FIG. 2, which detects the number of lamps in the ballast circuit.
Figure 8:
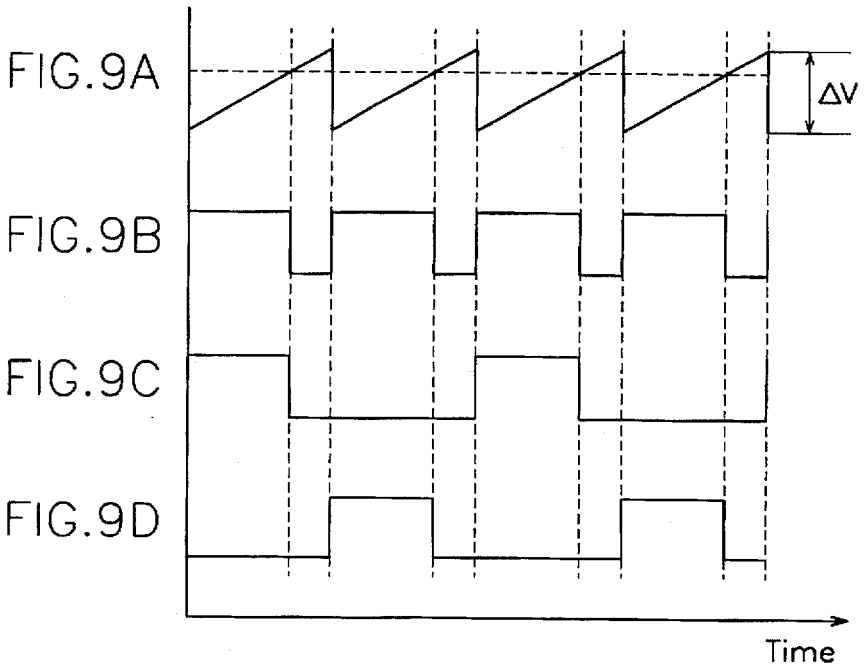

FIG. 8 is a detailed circuit of the n-lamp detector 5. As shown in FIG. 8, a n-lamp detector 5 includes a comparator for each lamp and an addition unit. When the voltage sensed by the comparators is lower than a reference voltage V, the comparators output a voltage $V_{1amp}$.

The output voltage $V_{1amp}$ of each comparator is summed in the addition unit to form an added voltage $nV_{1map}$, which corresponds to the number of lamps, and is input to the reference voltage generator 6 and soft start controller 4.

Taking soft start controller 4 as an example, if there are 3 lamps $3V_{1amp}$ is input to soft start controller 4 and $V_{1amp}$ is input to 3 cells separately in soft start controller Consequently 3 cells in soft start controller can be active.

FIG. 9 illustrates signal waveforms of various parts of the circuit shown in FIG. 3. FIG. 9A is a waveform of voltage charged in capacitor $C_t$ which is connected to the oscillator and driving circuit 314. FIG. 9B is a waveform of the output voltage of the comparator in the oscillator and driving circuit 314. FIG. 9C and 9D are driving signals $out_1$, $out_2$ generated by the oscillator and the driving circuit 314.

The driving signals $out_1$, $out_2$ are applied to the gate of switching element in ballast 1. ΔV as shown in FIG. 9A is the magnitude of the sawtooth signal. The relation of total current $i_t$, the magnitude ΔV of the sawtooth signal, control frequency $f_1$ of driving signal which is generated by control block 3 and capacitance of capacitor $C_t$ is expressed by the following equation, $$2\times f_1=i_t/(C_t\times\Delta V)$$

which illustrates that the control frequency $f_1$ is proportional to the total current $i_t$.

The dotted line as illustrated by FIG. 9A is a reference voltage of the comparator in the oscillator and driving circuit 314. The comparator output voltage waveform as shown in FIG. 9B is obtained by comparing the dotted line with the sawtooth wave as shown in FIG. 9A.

Comparator output voltage waveform as shown in FIG. 9B is divided by the flipflop in the oscillator and driving circuit 314. These divided signals, used to drive the ballast 1, are shown in FIG. 9C and 9D. The waveforms as shown in FIG. 9C and 9D have frequency $f_1$ on the basis of one-side of waveform.

As described above, the present invention provides a ballast feedback control system which can detect the number of lamps, control the ballast continuously through the use of a n-lamp detector and soft start controller which produces the compensated current from the feedback current and direct link voltage.

Therefore, the feedback control system according to this invention can control the ballast accurately against an external load change such as a change of input voltage, or a change in the number of lamps.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art which this invention pertains.

What is claimed is:

1. A switching type ballast feedback control system, comprising:

a ballast which generates a feedback current;

a detector which detects a number of lamps connected to the ballast;

a reference voltage generator which generates a reference voltage corresponding to the number of lamps detected by the detector;

a soft start controller unit which produces a first output current corresponding to the number of lamps detected by the detector in an initial preheat period, an instantaneous discharge period and a continuous discharge period;

a first feedback unit which multiplies said feedback current of the ballast with a direct link current applied to the ballast to obtain a multiplied current that is added to the first output current of the soft start controller unit to form a second output current;

a second feedback unit which converts the second output current into a voltage, produces an error voltage as a difference between the converted voltage and the reference voltage generated by the reference voltage generator and converts the error voltage into a third output current;

a main control unit which adds the third output current of the second feedback unit to a feedforward current and determines a control frequency of a driving signal of the ballast from this added current.

2. The control system of claim 1, wherein the soft start controller unit comprises:

a time controller which produces a voltage in proportion to the time;

a soft start controller which produces current according to the number of lamps in the initial preheat period, instantaneous discharge period, and continuous discharge period, which periods are distinguished by the output voltage of the time controller.

3. The control system of claim 1, wherein the main control unit comprises:

an inductor circuit to feedforward the direct link voltage supplied to the ballast;

a control block which adds the third output current of the second feedback unit to the feedforward current of the inductor circuit and determines the control frequency of the driving signal from this added current.

4. The control system of claim 1, wherein the first feedback unit comprises:

a multiplier which produces a multiplied current by multiplying the feedback current from the ballast with the direct link voltage; and an adder which adds the output current of the multiplier to the second output current of the soft start controller unit.

5. The control system of claim 1, wherein a second feedback unit comprises:

a current to voltage convertor which converts the second output current of the first feedback unit into voltage;

an adder which produces the error voltage by deducting the voltage of the current to voltage convertor from the reference voltage from the reference voltage generator;

a voltage to current convertor which converts the error voltage of the adder into current.

6. The control system of claim 1, wherein the detector comprises n comparators which detect the existence of lamps by comparing sensed voltages with internal voltages and output n output voltages;

an addition unit which adds the n output voltages of the n comparators and outputs the added voltage to the reference voltage generator and the soft start controller.

7. The control system of claim 2, wherein the soft stare controller comprises:

a current source to supply the divided current to n cells in circuit;

n cells which operate according to the output voltage of the n-lamp detector, said n cells producing a current corresponding to the output voltage of the n-lamp detector in proportion to the input time of the time controller, such that said n cells produce a constant current during the initial preheat period, produce a proportionally decreasing current during the instantaneous discharge period, and produce zero current during the continuous discharge period.

8. The control system of claim 7, wherein the current source comprises a current supplying unit having a transistor and wherein each of said n cells has a transistor in mirror relation with said transistor of said current supplying unit to divide said current to said n cells.

9. The control system of claim 7, wherein each of said n cells comprises:

a first transistor having a base, an emitter and a collector, the base of said first transistor being connected to the divided current from the current supplying unit;

a second transistor having a base, an emitter and a collector, the base and collector of said second transistor being joined and the collector of said second transistor being connected to the collector of said first transistor;

a third transistor having a base, an emitter and a collector, the base of said third transistor being is connected to the base of said second transistor and the collector of said third transistor being connected to the divided current from the current supplying unit;

a fourth transistor having a base, an emitter and a collector, the base of said fourth transistor being connected to the reference voltage to determine the discharge period, the collector of said fourth transistor being connected to the divided current from the current supplying unit, and the emitter of said fourth transistor being connected to the collector of said third transistor;

a fifth transistor having a base, an emitter and a collector, the emitter of said fifth transistor being connected to the collector of said fifth transistor through the resistor, the collector of said fifth transistor is connected to the emitter of said first transistor, and the base of said fifth transistor being connected to a voltage in proportion to the time controller;

a sixth transistor having a base, an emitter and a collector, the base of said sixth transistor being connected to the output voltage of the n-lamp detector, the collector and emitter of said sixth transistor being respectively connected to the base and emitter of said third transistor and controlling the turn-off of said third transistor according to the output voltage of the n-lamp detector.

10. The control system of claim 3, wherein the control block comprises:

an integrator which integrates the third output current of the second feedback unit and produces an output voltage;

a voltage-controlled current source which produces an output current according to the output voltage of the integrator;

an adder which adds the feedforward current of the inductor circuit to the reference current through the control block to form an added current and produces a total current by deducting the output current of the voltage-controlled current source from the added current;

an oscillator and driving circuit which receives the total current from the adder and compares the total current with an internal reference current and produces a driving signal to drive the switching element of the ballast by dividing the total current and the internal reference current.

11. The control system of claim 8, wherein each of said n cells comprises:

a first transistor having a base, an emitter and a collector, the base of said first transistor being connected to the divided current from the current supplying unit;

a second transistor having a base, an emitter and a collector, the base and collector of said second transistor being joined and the collector of said second transistor being connected to the collector of said first transistor;

a third transistor having a base, an emitter and a collector, the base of said third transistor being is connected to the base of said second transistor and the collector of said third transistor being connected to the divided current from the current supplying unit;

a fourth transistor having a base, an emitter and a collector, the base of said fourth transistor being connected to the reference voltage to determine the discharge period, the collector of said fourth transistor being connected to the divided current from the current supplying unit, and the emitter of said fourth transistor being connected to the collector of said third transistor;

a fifth transistor having a base, an emitter and a collector, the emitter of said fifth transistor being connected to the collector of said fifth transistor through the resistor, the collector of said fifth transistor is connected to the emitter of said first transistor, and the base of said fifth transistor being connected to a voltage in proportion to the time controller;

a sixth transistor having a base, an emitter and a collector, the base of said sixth transistor being connected to the output voltage of the n-lamp detector, the collector and emitter of said sixth transistor being respectively connected to the base and emitter of said third transistor and controlling the turn-off of said third transistor according to the output voltage of the n-lamp detector.

12. A ballast feedback control system, comprising:

a ballast which generates a feedback signal;

a detector which detects a number of lamps connected to the ballast;

a reference voltage generator which produces a first output signal corresponding to the number of lamps detected by the detector;

a soft start controller unit which produces a second output signal corresponding to the number of lamps detected by the detector in an initial preheat period, an instantaneous discharge period and a continuous discharge period;

a feedback unit which receives said first output signal, said second output signal and said feedback signal and generates a control signal to be applied to said ballast.

13. The ballast feedback control system of claim 1, wherein said control signal generated by said feedback unit has a frequency which varies according to at least one of said first output signal, said second output signal and said feedback signal.

* * * * *